US010907230B2

(12) United States Patent
Ryu et al.

(10) Patent No.: US 10,907,230 B2
(45) Date of Patent: Feb. 2, 2021

(54) ULTRA HIGH-STRENGTH AND HIGH-DUCTILITY STEEL SHEET HAVING EXCELLENT YIELD RATIO AND MANUFACTURING METHOD THEREFOR

(71) Applicants: POSCO, Pohang-si (KR); POSTECH ACADEMY-INDUSTRY FOUNDATION, Pohang-si (KR)

(72) Inventors: Joo-Hyun Ryu, Gwangyang-si (KR); Nack-Joon Kim, Pohang-si (KR); Sung-Hak Lee, Pohang-si (KR); Won-Hwi Lee, Gwangyang-si (KR); Kyoo-Young Lee, Gwangyang-si (KR); Sea-Woong Lee, Gwangyang-si (KR)

(73) Assignees: POSCO, Pohang-si (KR); POSTECH ACADEMY-INDUSTRY FOUNDATION, Pohang-si (KR)

( * ) Notice: Subject to any disclaimer, the term of this patent is extended or adjusted under 35 U.S.C. 154(b) by 211 days.

(21) Appl. No.: 16/094,323

(22) PCT Filed: Apr. 20, 2017

(86) PCT No.: PCT/KR2017/004212
§ 371 (c)(1),
(2) Date: Oct. 17, 2018

(87) PCT Pub. No.: WO2017/188654
PCT Pub. Date: Nov. 2, 2017

(65) Prior Publication Data

US 2019/0119770 A1 Apr. 25, 2019

(30) Foreign Application Priority Data

Apr. 28, 2016 (KR) ..... 10-2016-0052009

(51) Int. Cl.
*C21D 9/46* (2006.01)
*C21D 8/02* (2006.01)
(Continued)

(52) U.S. Cl.
CPC ..... *C21D 8/0247* (2013.01); *C21D 6/005* (2013.01); *C21D 6/008* (2013.01); *C21D 8/02* (2013.01);
(Continued)

(58) Field of Classification Search
CPC ..... C21D 8/0247; C21D 6/005; C21D 6/008; C21D 8/02; C21D 8/0226; C21D 8/0236;
(Continued)

(56) References Cited

U.S. PATENT DOCUMENTS 8,926,772 B2 1/2015 Bouzekri et al.
2008/0035248 A1 2/2008 Cugy et al.
(Continued)

FOREIGN PATENT DOCUMENTS

CN 101346480 1/2009
CN 102439188 5/2012
(Continued)

OTHER PUBLICATIONS

International Search Report—PCT/KR2017/004212 dated Jul. 11, 2017.
(Continued)

*Primary Examiner* — Scott R Kastler
(74) *Attorney, Agent, or Firm* — Cantor Colburn LLP

(57) ABSTRACT

Provided is an ultrahigh-strength steel sheet for a vehicle and, more specifically, to an ultrahigh-strength and high-ductility steel sheet having excellent yield ratio and a manufacturing method therefor. Provided is an ultrahigh-strength and high-ductility steel sheet for cold press forming and a manufacturing method therefor, the steel sheet ensur-
(Continued)

ing ultrahigh strength and high ductility since an alloy component of steel and manufacturing conditions are controlled and, simultaneously, having excellent impact characteristics due to a high yield strength ratio (yield ratio). Provided is the steel sheet capable of satisfying formability and impact stability, which are required for a vehicle steel sheet for cold forming, and replacing a conventional steel sheet for hot press forming, thereby reducing manufacturing costs.

9 Claims, 1 Drawing Sheet

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/00*** | (2006.01) |
| ***C21D 6/00*** | (2006.01) |
| ***C23C 2/02*** | (2006.01) |
| ***C23C 2/06*** | (2006.01) |
| ***C23C 2/28*** | (2006.01) |
| ***C23C 2/40*** | (2006.01) |
| *C22C 38/08* | (2006.01) |
| *C22C 38/16* | (2006.01) |
| *C22C 38/38* | (2006.01) |

(52) U.S. Cl.
CPC ..... *C21D 8/0226* (2013.01); *C21D 8/0236* (2013.01); *C21D 8/0263* (2013.01); *C21D 8/0273* (2013.01); *C21D 9/46* (2013.01); *C22C 38/00* (2013.01); *C22C 38/001* (2013.01); *C22C 38/02* (2013.01); *C22C 38/04* (2013.01); *C22C 38/06* (2013.01); *C22C 38/12* (2013.01); *C22C 38/14* (2013.01); *C23C 2/02* (2013.01); *C23C 2/06* (2013.01); *C23C 2/28* (2013.01); *C23C 2/40* (2013.01); *C21D 2211/001* (2013.01); *C21D 2211/005* (2013.01); *C22C 38/08* (2013.01); *C22C 38/16* (2013.01); *C22C 38/38* (2013.01)

(58) Field of Classification Search
CPC ..... C21D 8/0263; C22C 38/001; C22C 38/02; C22C 38/04; C22C 38/06; C22C 38/12; C22C 38/14
See application file for complete search history.

(56) References Cited

U.S. PATENT DOCUMENTS

| | | | | |
|---|---|---|---|---|
| 2009/0074605 | A1 | 3/2009 | Kim et al. | |
| 2009/0202382 | A1 | 8/2009 | Kim et al. | |
| 2012/0045358 | A1 | 2/2012 | Lee et al. | |
| 2013/0295409 | A1 | 11/2013 | Chin et al. | |
| 2014/0158257 | A1* | 6/2014 | Frehn | C22C 38/14 148/578 |
| 2014/0261918 | A1* | 9/2014 | Jin | C21D 6/005 148/620 |
| 2015/0211088 | A1 | 7/2015 | Kim et al. | |
| 2016/0186285 | A1 | 6/2016 | Kim et al. | |

FOREIGN PATENT DOCUMENTS

| | | |
|---|---|---|
| CN | 103370434 | 10/2013 |
| CN | 104011248 | 8/2014 |
| CN | 105473748 | 4/2016 |
| EP | 1649069 | 4/2006 |
| EP | 2208803 | 7/2010 |
| EP | 2544699 | 8/2016 |
| FR | 2878257 | 5/2006 |
| JP | 2004315960 | 11/2004 |
| KR | 20080060982 | 7/2008 |
| KR | 20090070504 | 7/2009 |
| KR | 20100071619 | 6/2010 |
| KR | 101115816 | 3/2012 |
| KR | 20130093743 | 8/2013 |
| KR | 20130138039 | 12/2013 |
| KR | 20140011498 | 1/2014 |
| KR | 20140014500 | 2/2014 |
| KR | 20140083781 | 7/2014 |
| KR | 20150073005 | 6/2015 |
| KR | 20150075324 | 7/2015 |
| WO | 2011122237 | 10/2011 |

OTHER PUBLICATIONS

European Search Report—European Application No. 17789839.2, dated Feb. 27, 2019, citing KR 2015 0075324, EP 2 208 803, KR 2009 0070504, KR 2010 0071619. FR 2 878 257 and EP 1 649 069.
Chinese Office Action—Chinese Application No. 201780025995.9 dated Jan. 9, 2020, citing CN101346480, CN103370434, CN105473748, CN104011248 and CN102439188.

* cited by examiner

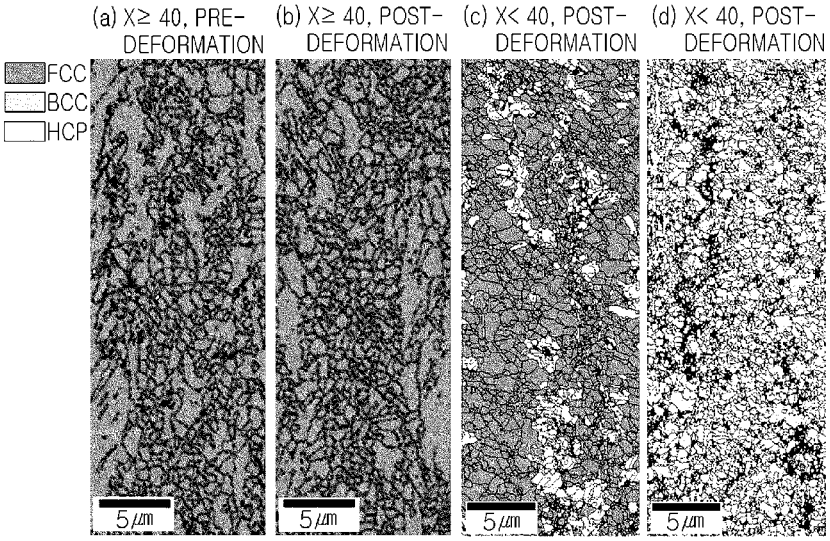
(a) X≥ 40, PRE-DEFORMATION
(b) X≥ 40, POST-DEFORMATION
(c) X< 40, POST-DEFORMATION
(d) X< 40, POST-DEFORMATION
FCC
BCC
HCP
5 μm
5 μm
5 μm
5 μm

ULTRA HIGH-STRENGTH AND HIGH-DUCTILITY STEEL SHEET HAVING EXCELLENT YIELD RATIO AND MANUFACTURING METHOD THEREFOR

TECHNICAL FIELD

The present disclosure relates to an ultra high-strength steel sheet for automobiles, and more particularly, to an ultra high-strength and high-ductility steel sheet having an excellent yield ratio, and a manufacturing method therefor.

BACKGROUND ART

In order to ensure the safety of passengers in the event of an automobile collision, safety regulations of automobiles are being strictly controlled. To this end, strength of a steel sheet for automobiles should be relatively increased, or a thickness thereof should be relatively increased.

Meanwhile, due to increasingly strict $CO_2$ emission regulations of automobiles, weight reductions of automobiles for achieving improvements in fuel efficiency are continuously required, and thus, the strength of a steel sheet for automobiles should necessarily be increased.

However, when the strength of a steel sheet for automobiles is relatively increased, ductility tends to be relatively lowered. Therefore, in the case of high-strength steel, use thereof in components requiring formability is limited.

In order to overcome the disadvantages of such high-strength steel, as a result of forming a component at a high temperature with good formability, and then rapidly cooling to room temperature to ensure a low-temperature structure, hot press formed steel ultimately having a high yield strength and a high tensile strength was developed.

However, there has been a problem, in that the cost of automobile components may be increased, due to the requirement for investments in hot press forming equipment by automobile component manufacturers, and an increase in processing costs due to the high temperature heat treatment.

Therefore, research into steel having high-strength and excellent elongation, suitable for cold press forming, has been continuously carried out.

For example, Patent Document 1 proposed an ultra high tensile strength steel sheet having a tensile strength of about 700 MPa to 900 MPa and excellent ductility of about 50% to 90% by adding C and Mn in amounts of 0.5% to 1.5% and 10% to 25%, respectively. However, since the proposed steel sheet has relatively low yield strength and tensile strength to deteriorate collision characteristics, as compared with a hot press forming steel, the steel sheet has a disadvantage in that its use as a structural member for automobiles is limited.

Meanwhile, Patent Document 2 proposed an ultra high-strength steel sheet, excellent in terms of collision characteristics having a tensile strength of 1300 MPa or more and a yield strength of 1000 MPa or more by adding C and Mn in amounts of 0.4% to 0.7% and 12% to 24%, respectively. However, since the proposed steel sheet has a relatively low elongation of about 10%, there is a limitation in producing a complicated-shaped component by cold press forming. In addition, since ultra high-strength may be secured by a re-rolling operation after an annealing operation among various operations in a process, complexity of a process and manufacturing costs are disadvantageously increased.

Therefore, there is demand for development of a steel sheet having an excellent yield strength ratio, as well as strength and ductility, to have collision characteristics, while being capable of replacing a steel sheet for hot press forming, without adding further operations.

(Patent Document 1) International Patent Publication No. WO2011-122237

(Patent Document 2) Korean Patent Publication No. 10-2013-0138039

DISCLOSURE

Technical Problem

An aspect of the present disclosure is to provide an ultra high-strength and high-ductility steel sheet for cold press forming having a high yield strength ratio (yield ratio) while securing ultra high-strength and high-ductility to have excellent collision characteristics, by controlling alloying components and manufacturing conditions of steel, and a manufacturing method therefor.

Technical Solution

According to an aspect of the present disclosure, an ultra high-strength and high-ductility steel sheet having an excellent yield ratio may include: by weight percentage (wt %), carbon (C): 0.4% to 0.9%, silicon (Si): 0.1% to 2.0%, manganese (Mn): 10% to 25%, phosphorus (P): 0.05% or less (excluding 0%), sulfur (S): 0.02% or less (excluding 0%), aluminum (Al): 4% or less (excluding 0%), vanadium (V): 0.7% or less (excluding 0%), molybdenum (Mo): 0.5% or less (excluding 0%), nitrogen (N): 0.02% or less (excluding 0%), a remainder of iron (Fe) and other unavoidable impurities, wherein, when the X value represented by the following Relationship 1 is 40 or more, a microstructure is composed of stable austenite single phase; when the X value is less than 40, a microstructure is composed of metastable austenite having an area fraction of 50% or more (including 100%) and ferrite phase, $$X=(80\times C)+(0.5\times Mn)-(0.2\times Si)-(0.4\times Al)-21 \quad \text{[Relationship 1]}$$

where, C, Mn, Si, and Al refer to the content by weight of each corresponding element.

According to an aspect of the present disclosure, a method for manufacturing an ultra high-strength and high-ductility steel sheet having an excellent yield ratio, includes: preparing a steel slab having the alloy composition described above; reheating the steel slab to a temperature within a range of 1050° C. to 1300° C.; subjecting the reheated steel slab to finish hot-rolling at a temperature within a range of 800° C. to 1000° C. to produce a hot-rolled steel sheet; coiling the hot-rolled steel sheet at a temperature within a range of 50° C. to 750° C.; pickling and cold-rolling the coiled hot-rolled steel sheet to produce a cold-rolled steel sheet; and annealing the cold-rolled steel sheet, wherein, when the X value represented by the Relationship 1 is 40 or more, the annealing operation is carried out at a temperature within a range of more than 700° C. to 840° C. or less for 10 minutes or less, and, when the X value is less than 40, the annealing operation is carried out at a temperature within a range of 610° C. to 700° C. for 30 seconds or more.

Advantageous Effects

According to an aspect of the present disclosure, a steel sheet capable of satisfying the formability and collision stability required for an automotive steel sheet for cold forming may be provided.

Further, according to an aspect of the present disclosure, manufacturing costs thereof may be relatively reduced by replacing a steel sheet for conventional hot press forming.

DESCRIPTION OF DRAWINGS

FIG. 1 illustrates the results of an electron backscatter diffraction (EBSD) phase map analysis of a microstructure of a steel sheet according to the X value of the Relationship 1, in an embodiment of the present disclosure (a: an annealed structure of Inventive Example 5, b: a post-deformation structure of Inventive Example 5, c: an annealed structure of Inventive Example 17, and d: a post-deformation structure of Inventive Example 17).

In this case, red refers to FCC (austenite) structure, green refers to BCC (ferrite or α'-martensite) structure, and white refers to HCP (ε-martensite) structure.

BEST MODE FOR INVENTION

The present inventors have conducted intensive research to develop a steel sheet suitable for cold press forming, capable of replacing an existing steel sheet for hot press forming, having a mechanical properties equal to or higher than the existing steel sheet, and reducing manufacturing costs. As a result, it has been found that an ultra high-strength and high-ductility steel sheet having excellent mechanical properties and microstructure and excellent yield strength suitable for cold press forming may be provided by optimizing component compositions and manufacturing conditions of steel, thereby completing the present disclosure.

Hereinafter, the present disclosure will be described in detail.

An ultra high-strength and high-ductility steel sheet having excellent yield strength according to one aspect of the present disclosure, comprises, by weight percentage (wt %), carbon (C): 0.4% to 0.9%, silicon (Si): 0.1% to 2%, manganese (Mn): 10% to 25%, phosphorus (P): 0.05% or less (excluding 0%), sulfur (S): 0.02% or less (excluding 0%), aluminum (Al): 4% or less (excluding 0%), vanadium (V): 0.7% or less (excluding 0%), molybdenum (Mo): 0.5% or less (excluding 0%), and nitrogen (N): 0.02% or less (excluding 0%).

Hereinafter, reasons for controlling alloying components of the ultra high-strength steel sheet provided by the present disclosure will be described in detail. At this time, unless otherwise specified, the content of each component means weight%.

C: 0.4% to 0.9%

Carbon (C) maybe an effective element for strengthening steel, and, in the present disclosure, may be an important element added for controlling the stability of austenite and securing the strength thereof. It is preferable to add C to 0.4% or more to obtain the above-mentioned effect. When the content thereof exceeds 0.9%, the stability of the austenite or the stacking fault energy may increase greatly, and the deformation induced martensite transformation or twin generation may be reduced, to be difficult to secure high-strength and high-ductility at the same time, and electrical resistivity may be increased, which may cause a deterioration in weldability.

Therefore, the content of C in the present disclosure is preferably limited to 0.4% to 0.9%.

Si: 0.1% to 2.0%

Silicon (Si) may be an element used as a deoxidizing agent in steel, but may be added, in the present disclosure, to obtain a solid solution strengthening effect which is advantageous for improving yield strength and tensile strength of steel. For this purpose, Si is preferably added in an amount of 0.1% or more. When the content thereof exceeds 2.0%, there maybe a problem that a large amount of silicon oxide is formed on the surface during hot-rolling, which reduces acidity and increases electrical resistivity to deteriorate weldability.

Therefore, in the present disclosure, it is preferable to limit the content of Si to 0.1% to 2.0%.

Mn: 10% to 25%

Manganese (Mn) may be an element effective for forming and stabilizing retained austenite while suppressing the transformation of ferrite. When Mn is added in an amount less than 10%, the stability of the retained austenite may become insufficient, resulting in deterioration of mechanical properties. Meanwhile, when the content thereof exceeds 25%, the increase of the alloying cost and the deterioration of the spot weldability may be caused.

Therefore, in the present disclosure, the content of Mn is preferably limited to 10% to 25%.

P: 0.05% or less (excluding 0%)

Phosphorus (P) may be solid solution strengthening element. When the content thereof exceeds 0.05%, there may be a problem that the weldability is lowered and the risk of brittleness of steel increases. Therefore, it is preferable to restrict the upper limit thereof to 0.05%, and more preferably to 0.02% or less.

S: 0.02% or less (excluding 0%)

Sulfur (S) may be an impurity element inevitably included in the steel, and may be an element that hinders ductility and weldability of the steel sheet. When the content of S exceeds 0.02%, the possibility of hindering the ductility and weldability of the steel sheet may be increased. Therefore, the upper limit thereof is preferably restricted to 0.02%.

Al: 4% or less (excluding 0%)

Aluminum (Al) may be an element usually added for deoxidation of steel, but in the present disclosure, may enhance the ductility and delayed fracture characteristics of steel by increasing the stacking fault energy. When the content of Al exceeds 4%, the tensile strength of the steel may be lowered. In addition, it may be difficult to produce a good slab through a reaction with a mold flux during casting, and also, surface oxides may be formed to deteriorate plating properties.

Therefore, in the present disclosure, the content of Al is preferably limited to 4% or less, and 0% may be excluded.

V: 0.7% or less (excluding 0%)

Vanadium (V) may be an element that reacts with carbon or nitrogen to form a carbonitride. In the present disclosure, V may play an important role in increasing the yield strength of steel by forming a fine precipitate at a relatively low temperature. When the content of V exceeds 0.7%, coarse carbonitride may be formed at a relatively high temperature, to lower hot workability and yield strength of the steel.

Therefore, in the present disclosure, the content of V is preferably limited to 0.7% or less, and 0% maybe excluded.

Mo: 0.5% or less (excluding 0%)

Molybdenum (Mo) maybe an element which forms carbide. When Mo is added with a carbonitride-forming element such as V and the like, the size of the precipitate may be maintained in a fine size to improve yield strength and tensile strength. When the content thereof exceeds 0.5%, there may be a problem that the above-mentioned effect is saturated, and production costs are increased.

Therefore, in the present disclosure, the content of Mo is preferably limited to 0.5% or less, and 0% may be excluded.

N: 0.02% or less (excluding 0%)

Nitrogen (N) may be solid solution strengthening element. When the content thereof exceeds 0.02%, a risk of the occurrence of brittleness may be increased, and excessive precipitation of AlN by bonding with Al may deteriorate quality in a continuous casting process.

Therefore, in the present disclosure, it is preferably to restrict the upper limit of N to 0.02%.

The present disclosure may further comprise the following components in addition to the above-mentioned components.

Specifically, the present disclosure may further include at least one selected from titanium (Ti): 0.005% to 0.1%, niobium (Nb): 0.005% to 0.1%, and tungsten (W): 0.005% to 0.5%.

Titanium (Ti), niobium (Nb), and tungsten (W) may be effective elements for precipitation strengthening and crystal grain refinement of the steel sheet by bonding with carbon in steel. In this case, 0.005% or more thereof, respectively, is preferably added to secure the above-mentioned effects sufficiently. When Ti and Nb exceed 0.1%, respectively, and W exceeds 0.5%, the above-mentioned effect may become saturated, and alloying costs may increase. In addition, there may be a problem that strength and ductility are deteriorated, as the precipitates are formed excessively, and C concentration in steel is lowered.

In addition, the present disclosure may further include at least one selected from nickel (Ni): 1% or less (excluding 0%), copper (Cu): 0.5% or less (excluding 0%), and chromium (Cr): 1% or less (excluding 0%).

The above nickel (Ni), copper (Cu), and chromium (Cr) may be elements contributing to stabilization of retained austenite, and may contribute to the stabilization of austenite by complicatedly acting in combination with C, Si, Mn, Al and the like.

Meanwhile, the content of Ni and Cr exceeds 1%, respectively, and the content of Cu exceeds 0.5%, there may be a problem that the manufacturing costs increase excessively. Since Cu may cause brittleness during hot-rolling, it is more preferable that Ni is added together with Cu.

The remainder of the present disclosure maybe iron (Fe). In the conventional steel manufacturing process, since impurities which are not intended from raw materials or the surrounding environment may be inevitably incorporated, the impurities may not be excluded. All of these impurities are not specifically mentioned in this specification, as they are known to anyone skilled in the art of steel making.

It is preferable that the steel sheet of the present disclosure having the above-described alloy composition comprises a microstructure with an austenite phase as a main phase.

More preferably, in the steel sheet of the present disclosure, when the X value represented by the following Relationship 1 is 40 or more, a microstructure is composed of stable austenite single phase; when the X value is less than 40, a microstructure is composed of metastable austenite having an area fraction of 50% or more (including 100%) and ferrite phase.

In this case, the stable austenite phase maybe astable structure in which phase transformation does not occur with respect to external deformation (for example, processing, tensile strain, etc.), and the metastable austenite phase may be a structure in which phase transformation occurs with respect to external deformation. Preferably, the metastable austenite phase maybe transformed into a hard phase such as α'-martensite or ε-martensite with respect to external deformation. Both the stable austenite phase and the metastable austenite phase may be advantageous in securing ultra high-strength.

In the present disclosure, when the X value is less than 40, the desired mechanical properties (ultra high-strength, ductility, collision characteristics, etc.) may be secured by securing the metastable austenite phase in a fraction of 50% or more. In this regard, at least 10% of phase transformation is preferably carried out in the metastable austenite phase during external deformation, $$X=(80\times C)+(0.5\times Mn)-(0.2\times Si)-(0.4\times Al)-21 \quad \text{[Relationship 1]}$$

where, C, Mn, Si, and Al refer to the content by weight of each corresponding element.

Therefore, the steel sheet of the present disclosure may have a greatly high tensile strength of 1400 MPa or more and a high yield strength to secure a yield ratio (yield strength (YS)/tensile strength (TS)) of 0.65 or more, by comprising a stable austenite phase in a microstructure, and comprising a composite structure of the ferrite phase and the metastable austenite phase transforming into a hard phase at the time of processing. For example, a steel sheet excellent in collision characteristics may be provided.

In addition, high-ductility may be secured, and the product of the tensile strength and the elongation may be as excellent as 25,000 MPa % or more.

The steel sheet referred to in the present disclosure may be not only a cold-rolled steel sheet, but also a hot-dip galvanized steel sheet or a galvannealed steel sheet obtained by plating the cold-rolled steel sheet.

Hereinafter, a method for manufacturing an ultra high-strength and high-ductility steel sheet having an excellent yield ratio, which may be another aspect of the present disclosure, will be described in detail.

First, a method of manufacturing a cold-rolled steel sheet according to the present disclosure will be described in detail below.

A cold-rolled steel sheet according to the present disclosure may be manufactured by preparing a steel slab satisfying the above-mentioned component composition, and then subjecting the steel slab to a reheating operation, a hot-rolling operation, a coiling operation, a cold-rolling operation, and an annealing operation, and each process conditions will be described in detail below.

Steel Slab Reheating Operation

In the present disclosure, before the hot-rolling operation, it is preferable that a steel slab previously prepared may be reheated to homogenize the steel slab. Preferably, the steel slab may be reheated to a temperature within a range of 1050° C. to 1300° C.

When the reheating temperature is less than 1050° C., there may be a problem that a load during the subsequent hot-rolling operation increases rapidly. When the reheating temperature is higher than 1300° C., not only the energy cost may increase, but also an amount of a surface scale may increase to lead a loss of the materials. In addition, when a large amount of Mn is included, a liquid phase may be present.

Therefore, it is preferable that the reheating operation of the steel slab is carried out at a temperature within a range of 1050° C. to 1300° C.

Hot-Rolling Operation

Preferably, the reheated steel slab may be hot-rolled to produce a hot-rolled steel sheet. In this case, the hot-rolled steel sheet is preferably subjected to finish hot-rolling operation at a temperature of 800° C. to 1000° C.

When the finish hot-rolling temperature is less than 800° C., there may be a problem that a rolling load increases greatly. Meanwhile, when the temperature exceeds 1000° C., surface defects due to the scale and shortening of the lifespan of the rolling roll may be caused.

Therefore, it is preferable that the finish hot-rolling operation is performed at a temperature within a range of 800° C. to 1000° C.

Coiling Operation

It is preferable that the hot-rolled steel sheet produced according to the above-mentioned operation may be rolled at a temperature within a range of 50° C. to 750° C.

When the coiling temperature exceeds 750° C., a scale of a surface of the steel sheet may be excessively formed to cause defects, which may cause deterioration of the plating ability. Meanwhile, when the content of Mn in the steel composition is 10% or more, the hardenability may greatly increase. Therefore, even after cooling to room temperature after a hot-rolling coiling operation, there may be no ferrite transformation. Therefore, a lower limit of the coiling temperature is not particularly restricted. Meanwhile, in the case of less than 50° C., cooling by cooling water spray may be required to lower the temperature of the steel sheet, which may cause an unnecessary increase in the process cost, and therefore, it is preferable to limit the coiling temperature to 50° C. or more.

When a martensitic transformation start temperature is not lower than room temperature, depending on the addition amount of Mn in the component composition of steel, martensite may be generated at room temperature. In this case, since the strength of the hot-rolled sheet is very high due to the martensite structure, a heat treatment may be additionally performed before the cold-rolling operation to reduce the load during the subsequent cold-rolling operation. Meanwhile, when the addition amount of Mn increases, and the transformation start temperature is lower than room temperature, the austenite single phase maybe maintained at room temperature. In this case, the cold-rolling operation may be performed immediately.

Pickling and Cold-Rolling Operations

It is preferable to carry out the cold-rolling operation to secure a shape of the steel sheet and a thickness required by the customer, after removing an oxide layer through the conventional pickling treatment of the hot-rolled steel sheet coiled according to the above operation.

Although a reduction ratio during cold-rolling is not particularly suggested, it is preferable that a cold-rolled reduction ratio of 25% or more is carried out to suppress the generation of coarse ferrite crystal grains during recrystallization in the subsequent annealing operation.

Annealing Operation

The present disclosure is to produce a steel sheet having not only excellent strength and ductility but also an excellent yield strength ratio. For this purpose, it is preferable to conduct an annealing operation according to the following conditions during the annealing operation.

Specifically, the present disclosure maybe carried out that, when the X value represented by the following Relationship 1 is 40 or more, the annealing operation is carried out at a temperature within a range of more than 700° C. to 840° C. or less for 10 minutes or less, and, when the X value is less than 40, the annealing operation is carried out at a temperature within a range of 610° C. to 700° C. for 30 seconds or more, $$X=(80\times C)+(0.5\times Mn)-(0.2\times Si)-(0.4\times Al)-21 \quad \text{[Relationship 1]}$$

where, C, Mn, Si, and Al refer to the content by weight of each corresponding element.

The above-mentioned Relationship 1 is to limit the content relationship of elements affecting stabilization of the austenite, and relatively express a magnitude of stacking fault energy of the austenite or stability of the austenite.

When the austenite is present in steel after annealing operation, a deformation mode may change depending on a value of the stacking fault energy. For example, when the stacking fault energy is relatively low, the austenite may exhibit a transformation induced plasticity phenomenon that is transformed into α'-martensite or ε-martensite with respect to an external deformation, and in a case of a value (approximately 10 to 40 $mJ/m^2$) greater than the above, a twining induced plasticity phenomenon may occur, and in a case of a value (approximately 40 $mJ/m^2$ or more) greater than the above, dislocation cells may be formed without specific phase transformation. Depending on the deformation mode, tensile properties such as tensile strength and elongation of steel may vary. Therefore, in the present disclosure, the stacking fault energy of the austenite in steel may be controlled by the component composition of steel and the annealing conditions, to obtain the mechanical properties at the desired level.

Since the content of C and Mn in the component composition of steel is relatively high, the cold-rolled steel sheet having an X value of 40 or more may be composed mainly of austenite single phase at room temperature during the annealing operation. At this time, the austenite may have stacking fault energy in which twining induced plasticity phenomenon shows. Therefore, in order to fully recrystallize the cold-rolled steel sheet having an X value of 40 or more, and minimize the grain size of the austenite, the steel sheet may be heated in a relatively high temperature range, e.g., at a temperature within a range of more than 700° C. to 840° C. for 30 seconds or more to 10 minutes or less, which is advantageous for securing tensile properties. At this time, when the annealing time is less than 30 seconds, recrystallization may not sufficiently take place and the elongation rate may be relatively deteriorated. Meanwhile, when the annealing time exceeds 10 minutes, since the crystal grains become too coarse to secure the desired level of strength, and amount of the formed annealed oxides are increased, there may be a problem in which the plating properties are relatively deteriorated.

In addition, the annealing temperature is 700° C. or less, recrystallization of the cold-rolled steel sheet may not occur sufficiently and it may be difficult to secure the elongation. Meanwhile, when the annealing temperature exceeds 840° C. or the annealing time exceeds 10 minutes, crystal grains of the austenite may grow coarsely, and the tensile strength of 1400 MPa or more may not be secured.

Meanwhile, when the content of C and Mn is relatively low in the component composition of steel and the value of X is less than 40, since it is required for the retained austenite to be secured at room temperature by utilizing two phase annealing operation and element distribution behavior to perform the heat treatment, or it is required to minimize the grain size of the austenite to increase the stability even when the heat treatment is performed in the single phase region of austenite, the heat treatment is preferably carried out in a relatively low temperature range, e.g., a temperature within a range of 610° C. to 700° C.

At this time, when the annealing temperature is less than 610° C., a proper fraction of austenite may not be secured during the heat treatment, or the annealing temperature may be relatively low and the recrystallization may be delayed, which may be disadvantageous in securing the elongation. Meanwhile, when the temperature exceeds 700° C., the crystal grain of austenite may be coarse and the mechanical stability of austenite may decrease, such that strength and ductility may not be secured at the same time. When the annealing operation is performed in a relatively low temperature range, it is preferable to conduct the heat treatment for 30 seconds or more in consideration of phase transformation kinetic. An upper limit thereof is not particularly restricted, but it is preferable that the upper limit is set within 60 minutes considering the productivity, or the like.

Meanwhile, in the present disclosure, the cold-rolled steel sheet annealed according to the above-described method may be plated to produce a plated steel sheet.

At this time, an electroplating method, a hot-dip coating method, or an alloying hot-dip coating method may be used. Specifically, a hot-dip galvanized steel sheet may be manufactured by immersing the cold-rolled steel sheet in a zinc plating bath. Further, the hot-dip galvanized steel sheet may be subjected to an alloying heat treatment to produce a galvannealed steel sheet.

Conditions for the plating treatment are not particularly limited, and the plating treatment can be carried out under conditions to be generally used.

Hereinafter, the present disclosure will be described more specifically by way of examples. It should be noted that the following examples are intended to illustrate the present disclosure in more detail and to not limit the scope of the present disclosure. The scope of the present disclosure may be determined by the matters described in the claims and the matters reasonably deduced therefrom.

MODE FOR INVENTION (Example)

Steel having a component composition illustrated in the following Table 1 was melted under vacuum to prepare an ingot of 30 Kg, and then maintained at a temperature of 1200° C. for 1 hour. Thereafter, hot-rolled and coiling operations were simulated as specimens that the ingot was subjected to the finish hot-rolling at 900° C. to prepare a hot-rolled steel sheet, the hot-rolled steel sheet was put into a furnace already heated at a temperature of 600° C. for 1 hour, and then cooled in the furnace. Thereafter, the specimens were cooled to room temperature, pickled and cold-rolled to obtain cold-rolled steel sheets. The cold-rolling operation was carried out at a cold reduction ratio of 40% or more.

Each of the cold-rolled steel sheets produced by the above-mentioned method was subjected to annealing operation under conditions illustrated in the following Table 2, and then the mechanical properties were measured for each specimen, and the microstructure was observed to determine the fraction of each structure. The results obtained therefrom are illustrated in the following Table 2.

The mechanical properties were evaluated by processing tensile specimens according to JIS No. 5 standard, and, then, performing a tensile test using a universal tensile tester.

TABLE 1

| | Component Composition (wt %) | | | | | | | | |
|---|---|---|---|---|---|---|---|---|---|
| Steel | C | Mn | Si | V | Al | Mo | P | S | N |
| *IS1 | 0.8 | 16 | 0.5 | 0.5 | 0.021 | 0.019 | 0.010 | 0.008 | 0.005 |
| IS2 | 0.8 | 20 | 0.5 | 0.5 | 0.025 | 0.022 | 0.015 | 0.007 | 0.006 |
| IS3 | 0.5 | 12 | 1 | 0.5 | 1.5 | 0.3 | 0.008 | 0.008 | 0.006 |
| IS4 | 0.4 | 13.5 | 1 | 0.5 | 1.0 | 0.3 | 0.009 | 0.006 | 0.004 |
| IS5 | 0.4 | 12 | 1 | 0.5 | 1.5 | 0.3 | 0.012 | 0.009 | 0.007 |
| IS6 | 0.5 | 12 | 1 | 0.5 | 3.0 | 0.3 | 0.009 | 0.008 | 0.009 |
| IS7 | 0.5 | 15 | 1 | 0.5 | 1.0 | 0.3 | 0.007 | 0.007 | 0.008 |
| **CS1 | 0.3 | 15 | 1 | 0.5 | 1.0 | 0.3 | 0.011 | 0.007 | 0.007 |
| CS2 | 0.2 | 15 | 1 | 0.5 | 1.0 | 0.3 | 0.011 | 0.004 | 0.005 |
| CS3 | 0.1 | 15 | 1 | 0.5 | 1.0 | 0.3 | 0.009 | 0.009 | 0.004 |
| CS4 | 0.5 | 12 | 0 | 0.3 | 3.0 | 0.3 | 0.008 | 0.007 | 0.006 |
| CS5 | 0.7 | 12 | 1 | 0.5 | 5.0 | 0.3 | 0.010 | 0.009 | 0.009 |
| CS6 | 0.7 | 12 | 0 | 0.3 | 5.0 | 0.3 | 0.011 | 0.005 | 0.005 |

*IS: Inventive Steel,

**CS: Comparative Steel

TABLE 2

| | X value | Annealing conditions | | Mechanical properties | | | | | Micro-structure | | |
|---|---|---|---|---|---|---|---|---|---|---|---|
| Steel | (Relationship 1) | Temperature (° C.) | Time (min) | YS (MPa) | TS (MPa) | El (%) | YR | TS × El (MPa %) | F (%) | γ (%) | Examples |
| *IS1 | 51 | 600 | 60 | 1131 | 1278 | 4 | 0.88 | 5112 | 0 | 100 | ****CE1 |
| | 51 | 620 | 1 | 1135 | 1590 | 13 | 0.71 | 20670 | 0 | 100 | CE2 |
| | 51 | 650 | 60 | 1004 | 1238 | 10 | 0.81 | 12380 | 0 | 100 | CE3 |
| | 51 | 700 | 1 | 1107 | 1577 | 16 | 0.70 | 25232 | 0 | 100 | ***IE1 |
| | 51 | 775 | 15 | 818 | 1327 | 35 | 0.62 | 46445 | 0 | 100 | CE4 |
| | 51 | 800 | 1 | 1119 | 1495 | 20 | 0.75 | 29900 | 0 | 100 | IE2 |
| | 51 | 810 | 1 | 995 | 1431 | 31 | 0.70 | 44361 | 0 | 100 | IE3 |
| | 51 | 830 | 1 | 1007 | 1455 | 37 | 0.69 | 53835 | 0 | 100 | IE4 |
| | 51 | 850 | 1 | 699 | 1387 | 13 | 0.50 | 18031 | 0 | 100 | CE5 |
| | 51 | 850 | 5 | 733 | 1348 | 55 | 0.54 | 74140 | 0 | 100 | CE6 |
| | 51 | 850 | 15 | 629 | 1260 | 38 | 0.50 | 47880 | 0 | 100 | CE7 |
| IS2 | 53 | 600 | 60 | 1105 | 1360 | 17 | 0.81 | 23120 | 0 | 100 | CE8 |
| | 53 | 620 | 1 | 1311 | 1586 | 12 | 0.83 | 19032 | 0 | 100 | CE9 |
| | 53 | 650 | 60 | 948 | 1313 | 25 | 0.72 | 32825 | 0 | 100 | CE10 |
| | 53 | 700 | 1 | 1195 | 1522 | 25 | 0.79 | 38050 | 0 | 100 | IE5 |
| | 53 | 775 | 15 | 787 | 1303 | 40 | 0.60 | 52120 | 0 | 100 | CE11 |
| | 53 | 800 | 1 | 1096 | 1461 | 34 | 0.75 | 49674 | 0 | 100 | IE6 |
| | 53 | 810 | 1 | 1130 | 1462 | 30 | 0.77 | 43860 | 0 | 100 | IE7 |
| | 53 | 830 | 1 | 1065 | 1433 | 34 | 0.74 | 48722 | 0 | 100 | IE8 |
| | 53 | 850 | 5 | 748 | 1392 | 47 | 0.54 | 65424 | 0 | 100 | CE12 |
| | 53 | 850 | 1 | 791 | 1325 | 52 | 0.60 | 68900 | 0 | 100 | CE13 |
| | 53 | 850 | 15 | 612 | 1226 | 49 | 0.50 | 60074 | 0 | 100 | CE14 |

TABLE 2-continued

| Steel | X value (Relationship 1) | Annealing conditions Temperature (° C.) | Time (min) | Mechanical properties YS (MPa) | TS (MPa) | El (%) | YR | TS × El (MPa %) | Micro-structure F (%) | γ (%) | Examples |
|---|---|---|---|---|---|---|---|---|---|---|---|
| IS3 | 24 | 600 | 10 | 1376 | 1590 | 8 | 0.87 | 12720 | 0 | 100 | CE15 |
| | 24 | 650 | 10 | 1336 | 1529 | 20 | 0.87 | 30580 | 0 | 100 | IE9 |
| | 24 | 700 | 10 | 1150 | 1409 | 23 | 0.82 | 32407 | 0 | 100 | IE10 |
| | 24 | 750 | 10 | 937 | 1160 | 15 | 0.81 | 17400 | 0 | 100 | CE16 |
| IS4 | 17 | 700 | 3 | 1122 | 1495 | 27 | 0.75 | 40365 | 0 | 100 | IE11 |
| | 17 | 750 | 10 | 822 | 1308 | 26 | 0.63 | 34008 | 0 | 100 | CE17 |
| IS5 | 16 | 600 | 10 | 1242 | 1473 | 11 | 0.84 | 16203 | 5 | 95 | CE18 |
| | 16 | 650 | 10 | 1235 | 1497 | 25 | 0.82 | 37425 | 4 | 96 | IE12 |
| | 16 | 700 | 10 | 1046 | 1605 | 38 | 0.65 | 60990 | 2 | 98 | IE13 |
| | 16 | 750 | 10 | 866 | 1147 | 19 | 0.76 | 21793 | 0 | 100 | CE19 |
| IS6 | 24 | 650 | 10 | 1390 | 1521 | 49 | 0.91 | 74529 | 41 | 59 | IE14 |
| | 24 | 650 | 30 | 1270 | 1434 | 46 | 0.89 | 65964 | 38 | 62 | IE15 |
| | 24 | 675 | 10 | 1322 | 1450 | 44 | 0.91 | 63800 | 28 | 72 | IE16 |
| | 24 | 700 | 10 | 1189 | 1404 | 54 | 0.85 | 75816 | 24 | 76 | IE17 |
| | 24 | 750 | 10 | 900 | 1074 | 22 | 0.84 | 23628 | 8 | 92 | CE20 |
| | 24 | 800 | 10 | 760 | 973 | 18 | 0.78 | 17514 | 1 | 99 | CE21 |
| IS7 | 26 | 600 | 10 | 1298 | 1534 | 12 | 0.85 | 18408 | 0 | 100 | CE22 |
| | 26 | 650 | 10 | 1237 | 1475 | 26 | 0.84 | 38350 | 0 | 100 | IE18 |
| | 26 | 700 | 10 | 1067 | 1411 | 30 | 0.76 | 42330 | 0 | 100 | IE19 |
| | 26 | 750 | 10 | 915 | 1232 | 39 | 0.74 | 48048 | 0 | 100 | CE23 |
| **CS1 | 10 | 600 | 10 | 1373 | 1607 | 8 | 0.85 | 12856 | 16 | 84 | CE24 |
| | 10 | 650 | 10 | 1279 | 1494 | 7 | 0.86 | 10458 | 5 | 95 | CE25 |
| | 10 | 700 | 10 | 1006 | 1366 | 45 | 0.74 | 61470 | 2 | 98 | CE26 |
| | 10 | 750 | 10 | 817 | 1289 | 52 | 0.63 | 67028 | 0 | 100 | CE27 |
| CS2 | 2 | 600 | 10 | 1430 | 1650 | 8 | 0.87 | 13200 | 14 | 86 | CE28 |
| | 2 | 650 | 10 | 1250 | 1474 | 10 | 0.85 | 14740 | 11 | 89 | CE29 |
| | 2 | 700 | 10 | 940 | 1332 | 45 | 0.71 | 59940 | 2 | 98 | CE30 |
| | 2 | 750 | 10 | 778 | 1287 | 47 | 0.60 | 60489 | 1 | 99 | CE31 |
| CS3 | −6 | 600 | 10 | 1443 | 1445 | 1 | 1.00 | 1445 | 26 | 74 | CE32 |
| CS3 | −6 | 650 | 10 | 1263 | 1392 | 5 | 0.91 | 6960 | 16 | 84 | CE33 |
| | −6 | 700 | 10 | 851 | 1228 | 32 | 0.69 | 39296 | 5 | 95 | CE34 |
| | −6 | 750 | 10 | 559 | 1147 | 31 | 0.49 | 35557 | 0 | 100 | CE35 |
| CS4 | 24 | 650 | 10 | 1161 | 1288 | 36 | 0.90 | 46368 | 38 | 62 | CE36 |
| | 24 | 650 | 10 | 1041 | 1188 | 26 | 0.88 | 30888 | 19 | 81 | CE37 |
| | 24 | 700 | 10 | 846 | 1065 | 31 | 0.79 | 33015 | 21 | 79 | CE38 |
| CS5 | 39 | 650 | 10 | 1518 | 1620 | 4 | 0.94 | 6480 | 5 | 95 | CE39 |
| | 39 | 700 | 10 | 1403 | 1480 | 11 | 0.95 | 16280 | 0 | 100 | CE40 |
| | 39 | 750 | 10 | 764 | 814 | 16 | 0.94 | 13024 | 0 | 100 | CE41 |
| CS6 | 39 | 650 | 10 | 1444 | 1542 | 9 | 0.94 | 13878 | 0 | 100 | CE42 |
| | 39 | 700 | 10 | 1258 | 1321 | 12 | 0.95 | 15852 | 0 | 100 | CE43 |
| | 39 | 750 | 10 | 971 | 1094 | 31 | 0.89 | 33914 | 0 | 100 | CE44 |

*IS: Inventive Steel,
**CS: Comparative Steel,
***IE: Inventive Example,
****CE: Comparative Example (In Table 2, YS denotes yield strength, TS denotes tensile strength, E1 denotes elongation, YR denotes a yield ratio (YS/TS), F means ferrite, and y means austenite)

As illustrated in Tables 1 and 2, Inventive Examples 1 to 19 satisfying all of the component composition and manufacturing conditions proposed in the present disclosure not only have an ultra high-strength with a tensile strength of 1400 MPa or more, but also have a yield ratio of 0.65 or more and excellent elongation, such that the value of tensile strength×elongation may be secured at 25000 MPa % or more. Therefore, it may be confirmed that the steel sheet according to the present disclosure may be very advantageous as a steel sheet for cold press forming, which may replace the conventional steel sheet for hot press forming.

Particularly, in each of Examples 1 to 8 in which the value of X is 40 or more, a stable single phase structure of austenite was formed. In Examples 9 to 19 in which the value of X is less than 40, a single phase structure of austenite was formed or an austenite+ferrite complex structure was formed, wherein the austenite phase was all metastable austenite phase.

Meanwhile, even when the component composition of the present disclosure is satisfied, but when the production conditions (annealing step) do not satisfy the present disclosure, it may be difficult to secure the desired mechanical properties.

In Comparative Examples 1-3 and 8-10, since the annealing temperatures were less than 700° C., and the recrystallizations did not sufficiently take place, the elongation therefrom was deteriorated. In Comparative Examples 4, 5-7, 11 and 12-14, since the annealing temperatures exceeded 10 minutes or the annealing temperatures exceeded 840° C., the crystal grains were grew coarsely and the strength and yield ratios therefrom were deteriorated.

In addition, in Comparative Examples 15, 18 and 22, in which the annealing temperature was less than 610° C., the elongation therefrom was deteriorated, and in Comparative Examples 16, 17, 19-21 and 23 exceeding 700° C., it was difficult to secure ultra high-strength.

In addition, even when the steel manufacturing conditions satisfy the present disclosure, but when the steel component composition does not satisfy the present disclosure, e.g., in Comparative Examples 25, 26, 29, 30, 33, 34, 37-40, and 43, the strength and elongation therefrom were deteriorated.

FIG. 1 illustrates the results of an electron backscatter diffraction (EBSD) phase map analysis of a microstructure of a steel sheet according to the X value of the Relationship 1. The microstructure was obtained by observing a microstructure (annealed structure) of the steel sheet completed to the annealing operation, and a microstructure after tensile strain was applied to the steel sheet.

As illustrated in FIG. 1, in Inventive Example 5 having an X value of 40 or more, it can be seen that the annealed structure may be composed of a single phase of austenite (a), and the austenite maybe stable austenite since there is no phase transformation even after deformation (b). Meanwhile, in Inventive Example 17 having an X value of less than 40, the annealed structure may be composed of 50% or more of austenite and the remainder being ferrite (c), wherein the austenite may be metastable austenite to be transformed into α'-martensite or ε-martensite by deformation (d).

While exemplary embodiments have been illustrated and described above, it will be apparent to those skilled in the art that deformations and variations could be made without departing from the scope of the present disclosure as defined by the appended claims.

The invention claimed is:

1. An ultra high-strength and high-ductility steel sheet having an excellent yield ratio, the steel sheet comprising:

by weight percentage (wt %), carbon (C): 0.4% to 0.9%, silicon (Si): 0.1% to 2.0%, manganese (Mn): 10% to 25%, phosphorus (P): 0.05% or less excluding 0%, sulfur (S): 0.02% or less excluding 0%, aluminum (Al): 4% or less excluding 0%, vanadium (V): 0.7% or less excluding 0%, molybdenum (Mo): 0.5% or less excluding 0%, nitrogen (N): 0.02% or less excluding 0%, a remainder of iron (Fe) and other unavoidable impurities;

a microstructure including: a stable austenite single phase when an X value represented by the following Relationship 1 is 40 or more; and a metastable austenite having an area fraction of 50% to 100% and a ferrite phase having an area fraction of 0% to 50% when an X value represented by the following Relationship 1 is less than 40, $$X=(80\times C)+(0.5\times Mn)-(0.2\times Si)-(0.4\times Al)-21 \quad \text{[Relationship 1]}$$

where C, Mn, Si, and Al refer to a content by weight of each corresponding element; and a yield ratio of 0.65 or more.

2. The ultra high-strength and high-ductility steel sheet according to claim 1, further comprising by weight percentage (wt %), at least one selected from the group consisting of titanium (Ti): 0.005% to 0.1%, niobium (Nb): 0.005% to 0.1%, and tungsten (W): 0.005 to 0.5%.

3. The ultra high-strength and high-ductility steel sheet according to claim 1, further comprising: by weight percentage (wt %), at least one selected from the group consisting of nickel (Ni): 1% or less excluding 0%, copper (Cu): 0.5% or less excluding 0%, and chromium (Cr): 1% or less excluding 0%.

4. The ultra high-strength and high-ductility steel sheet according to claim 1, wherein the steel sheet comprises: one of a cold-rolled steel sheet, a hot-dip galvanized steel sheet, and a galvannealed steel sheet.

5. A method for manufacturing an ultra high-strength and high-ductility steel sheet having an excellent yield ratio, the method comprising:

preparing a steel slab comprising, by weight percentage (wt %), carbon (C): 0.4% to 0.9%, silicon (Si): 0.1% to 2.0%, manganese (Mn): 10% to 25%, phosphorus (P): 0.05% or less excluding 0%, sulfur (S): 0.02% or less excluding 0%, aluminum (Al): 4% or less excluding 0%, vanadium (V): 0.7% or less excluding 0%, molybdenum (Mo): 0.5% or less excluding 0%, nitrogen (N): 0.02% or less excluding 0%, a remainder of iron (Fe) and other unavoidable impurities;

reheating the steel slab to a temperature within a range of 1050° C. to 1300° C. to produce a reheated steel slab;

finish hot-rolling the reheated steel slab at a temperature within a range of 800° C. to 1000° C. to produce a hot-rolled steel sheet;

coiling the hot-rolled steel sheet at a temperature within a range of 50° C. to 750° C. to produce a coiled hot-rolled steel sheet;

pickling and cold-rolling the coiled hot-rolled steel sheet to produce a cold-rolled steel sheet; and annealing the cold-rolled steel sheet to produce an annealed cold-rolled steel sheet, wherein the annealing comprises: annealing the cold-rolled steel sheet at a temperature within a range of 700° C. to 840° C. for 10 minutes or less, when an X value represented by the following Relationship 1 is 40 or more, or wherein the annealing comprises: annealing the cold-rolled steel sheet a temperature within a range of 610° C. to 700° C. for 30 seconds or more when an X value represented by the following Relationship 1 is less than 40, $$X=(80\times C)+(0.5\times Mn)-(0.2\times Si)-(0.4\times Al)-21 \quad \text{[Relationship 1]}$$

where C, Mn, Si, and Al refer to a content by weight of each corresponding element.

6. The method according to claim 5, wherein the steel slab further comprises, by weight percentage (wt %), at least one selected from the group consisting of titanium (Ti): 0.005% to 0.1%, niobium (Nb): 0.005% to 0.1%, and tungsten (W): 0.005 to 0.5%.

7. The method according to claim 5, wherein the steel slab further comprises, by weight percentage (wt %), at least one selected from the group consisting of nickel (Ni): 1% or less excluding 0%, copper (Cu): 0.5% or less excluding 0%, and chromium (Cr): 1% or less excluding 0%.

8. The method according to claim 5, further comprising: dipping the annealed cold-rolled steel sheet in a zinc plating bath to produce a hot-dip galvanized steel sheet.

9. The method according to claim 8, further comprising: subjecting the hot-dip galvanized steel sheet to an alloying heat treatment to produce a galvannealed steel sheet.

* * * * *